US007223065B2

(12) United States Patent
Suter

(10) Patent No.: US 7,223,065 B2
(45) **Date of Patent: *May 29, 2007**

(54) STEAM TURBINE

(75) Inventor: Franz Suter, Gebenstorf (CH)

(73) Assignee: ALSTOM Technology Ltd, Baden (CH)

( * ) Notice: Subject to any disclaimer, the term of this patent is extended or adjusted under 35 U.S.C. 154(b) by 80 days.

This patent is subject to a terminal disclaimer.

(21) Appl. No.: 10/979,239

(22) Filed: Nov. 3, 2004

(65) Prior Publication Data

US 2005/0063818 A1 Mar. 24, 2005

Related U.S. Application Data

(63) Continuation of application No. PCT/EP03/50099, filed on Apr. 10, 2003.

(30) Foreign Application Priority Data

May 3, 2002 (DE) ..... 102 19 948

(51) Int. Cl.
*F01D 17/10* (2006.01)

(52) U.S. Cl. ..... 415/155; 137/613

(58) Field of Classification Search ..... 415/155
See application file for complete search history.

(56) References Cited

U.S. PATENT DOCUMENTS 1,786,474 A * 12/1930 Bickel ..... 137/613
2,165,175 A 7/1939 Dickey et al.
3,007,489 A 11/1961 Biddle
5,018,356 A 5/1991 Silvestri, Jr. et al.
6,637,207 B2 * 10/2003 Konezciny et al. ..... 137/613

FOREIGN PATENT DOCUMENTS

| | | |
|---|---|---|
| CH | 584 349 | 4/1975 |
| DE | 2 51 699 | 4/1912 |
| DE | 1 035 159 | 7/1958 |
| DE | 26 26 474 | 12/1976 |
| EP | 0 075 212 | 3/1983 |
| EP | 0 361 835 | 4/1990 |
| FR | 2 206 438 | 6/1974 |
| JP | 61 126304 | 6/1986 |
| JP | 09195709 | 7/1997 |

OTHER PUBLICATIONS

"ABB Modular Reheat Steam Turbines", ABB Power Generation, ABB Review No. 5/1990, HTGD 666 159, printed in Germany, Sep. 1994, pp. 3-10.

* cited by examiner

*Primary Examiner*—Richard A. Edgar
(74) *Attorney, Agent, or Firm*—Buchanan Ingersoll & Rooney PC

(57) ABSTRACT

The invention relates to a steam turbine comprising a valve arrangement for regulating the admission of live steam into the turbine consisting of two serially connected regulating valves. The two regulating valves enable a step-by-step separation of the live steam and ensure operational security in the case of a partial load operation of the turbine. Said valve arrangement is particularly suitable for steam turbines devoid of regulating steps in a fixed-pressure operation mode.

8 Claims, 3 Drawing Sheets

STEAM TURBINE

FIELD OF THE INVENTION

The invention relates to a steam turbine, and especially a valve arrangement for the admission of live steam to the steam turbine.

BACKGROUND OF THE INVENTION

Steam turbines are known in which the in-flow of live steam is controlled by nozzle regulation by means of a control stage, also called the first turbine stage. Such a control stage exhibits, for example, admission sectors of varying sizes, to which the live steam is fed, in each case, by way of a live steam feed in-flow with several control valves. As a safety measure, a quick-acting stop valve is arranged in series prior the control valves. Such an arrangement is disclosed, for example, in the sales documentation of ABB Power Generation, Description No. HTGD N 12 018.

These steam turbines are typically operated at a live steam pressure that is fixedly set by the steam generator's operating parameters for all of the steam turbines' operating loads. As a result of various settings of the three or four control valves, the steam turbine can be operated at a plurality of partial load points, as well as within the load ranges pertaining to these partial load points. For this purpose, the control valves, which may be activated sequentially, are either closed or fully opened, or opened in a controlled manner.

Additional known steam turbines are operated without a control stage. The latter typically exhibit one or two live steam inlets, with a stop valve and a control valve arranged in series, in each case. Such steam turbines are disclosed, for example, in the sales documentation of ABB Power Generation, Description No. HTGD 666 159, and a valve arrangement provided therein for controlling the live steam in-flow in the same sales documentation, Description No. GMDT N06 014. The live steam pressure in these steam turbines can be variable, such as, for example, in the case of steam turbine facilities for variable pressure operation, or in the case of steam turbine facilities with a circuit combined with that of a gas turbine facility. In the case of newer steam turbine facilities, however, the live steam pressure can also be set to one single pressure level for all operating loads.

The valves in the aforementioned steam turbine facilities are preferably so configured that valve oscillations due to increased stress are kept within limits, and an operational valve life that is as long as possible and devoid of harm, is afforded.

In the steam turbines without a control stage, and particularly among those that are operated at a fixed live steam pressure, the valves must be in constantly throttled operation in order to render a safe partial load operation of the steam turbine possible. Consequently, the valves are exposed to an elevated stress in comparison with the steam turbines with a control step. Among steam turbines without a control step, the pressure is reduced by way of the valves exclusively, whereas in the case of steam turbines with a control stage, the pressure is reduced by way of the valve and the nozzles arranged in series prior to the valves. The stop valves assure safety for the live steam in-flow, but they cannot assume any throttling function. If a steam turbine is operated at fixed pressure, elevated stresses and critical pressure conditions arise in the control valves, which cause correspondingly elevated valve oscillations and an elevated risk of damage.

This is the case, in particular, in steam turbines without a control stage and throttled operation in partial load operation.

SUMMARY OF THE INVENTION

In view of these disadvantages of the known valve arrangements for live steam intake, it is the object of the present invention to create a valve arrangement for controlling the live steam in-flow into a steam turbine that exhibits a reduced risk of damage, even in the reduction of rather great pressures, in particular.

According to the invention, a steam turbine exhibits a valve arrangement for the purpose of controlling the live steam in-flow, which consists of two control valves, which are arranged in series.

The valve arrangement according to the invention, in the case of partial load operation, allows a stepwise reduction of the loss of pressure by way of the two individual control valves, that is, the converted energy in the case of throttled operation is distributed to the two or more control valves. By these means, compared to a valve arrangement with a quick-acting stop valve together with just one control valve, the stress imposed upon one individual control valve is markedly reduced. The risk of valve oscillations and potential valve damage as a consequence thereof, is reduced by these means. The first control valve can, in the case of the arrangement according to the invention, assume the safety function of a quick-acting stop valve, so that the safety provided by this valve arrangement is not diminished in comparison with the state of the art.

The valve arrangement according to the invention can, in the case of steam turbines, be used, either with or without a control stage. In the case of steam turbines without a control stage, it reduces, in particular, the relatively high stresses imposed on the control valves. Furthermore, it lends itself well to steam turbines with fixed pressure operation, and in operation with variable live steam pressure. Once again, the valve arrangement according to the invention is particularly effective in steam turbines without a control stage and especially in the case of those in fixed pressure operation for the reduction of stress-related valve oscillations.

The valve arrangement preferably exhibits control valves of the balanced valve type, or of a balanced single-seated valve with a pilot stroke.

The valve arrangement yields the advantage that the problems of the potential valve oscillations, particularly in the case of steam turbines without a control step and in the case of fixed pressure operation, are solved by a simple arrangement of a single valve type, without incurring any losses in terms of safety. Furthermore, it renders the advantage possible, in that known control valves and actuating drives can be used. The same drive is used, preferably, for all control valves.

More precise descriptions of the inventions by virtue of the figures follow.

DETAILED DESCRIPTION OF THE INVENTION

Figure 1:
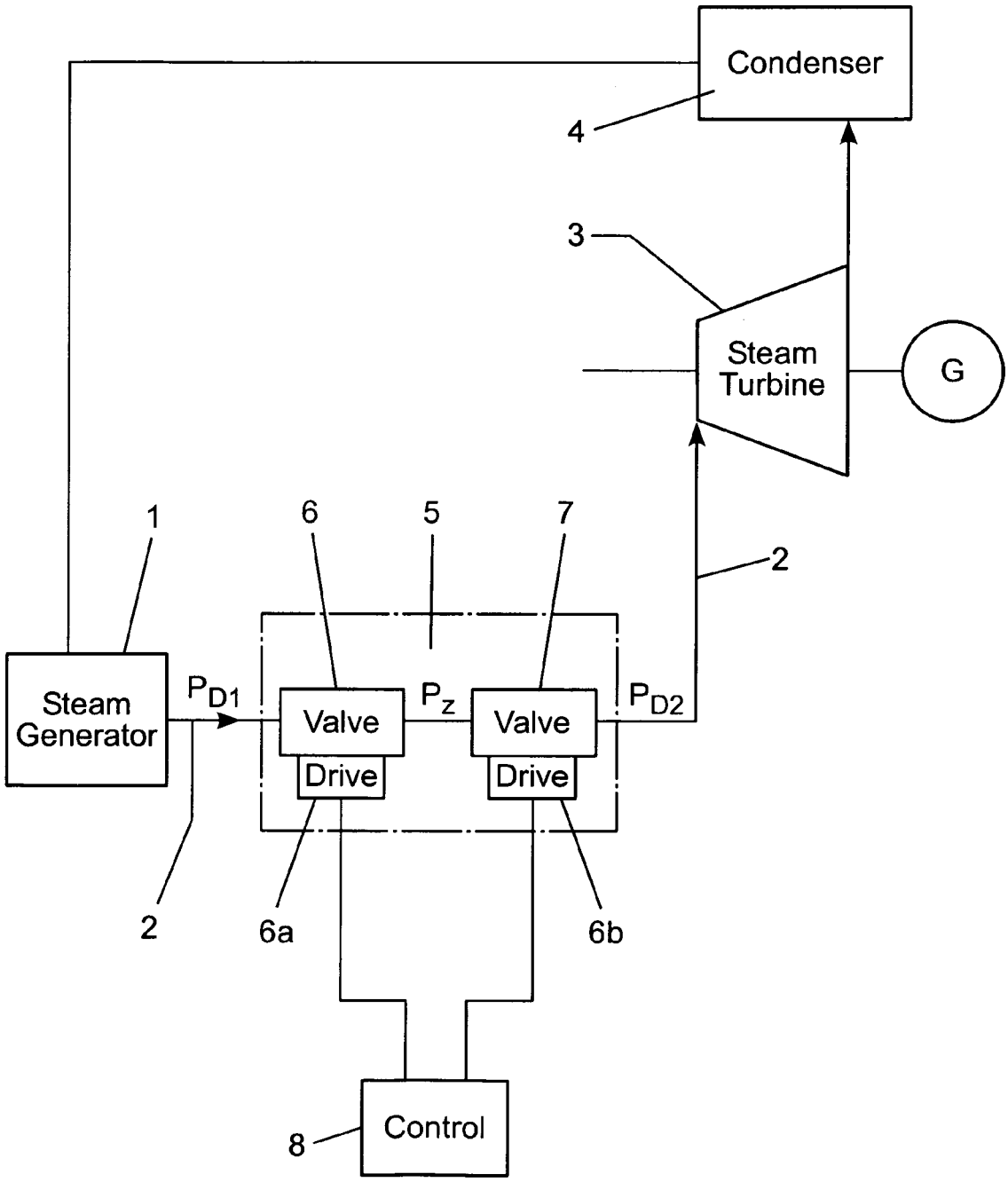
FIG. 1 shows a schematic of a steam turbine facility in which the valve arrangement according to the invention is used to control the live steam in-flow.

FIG. 1 shows, schematically, a steam turbine facility with a steam generator 1, which is connected, by means of a live steam feed line 2, with a steam turbine 3. The steam turbine 3 is coupled to a generator G. The steam, whose pressure is released in the turbine, is led to a condenser 4, whereby the condensation that arises there is again led to the facility's water-steam circuit. Feed line 2 exhibits a valve arrangement 5 for the purpose of controlling the live steam pressure in accordance with a prescribed operational load. Here, in the direction of flow, the valve arrangement exhibits a first control valve 6 and a second control valve 7, which are arranged in series. The control valves 6 and 7 each exhibit an actuating drive 6*a* or 6*b*, respectively, which are connected with a open-loop or closed-loop control apparatus 8. Both control valves can be placed in a fully closed position, a fully open position, or any arbitrary partially open position by means of the control apparatus. The first control valve 6, in particular, can also assume the function of a quick-acting stop valve.

As it enters the valve arrangement 5, the live steam that is generated in the steam generator 1 possesses a live steam pressure $P_{D1}$, which is reduced there, stepwise, by way of the interim pressure $P_z$ to a steam pressure $P_{D2}$, which corresponds to a full operational load or a prescribed partial load.

The actuating drives 6*a* and 6*b* can for example, be embodied as a hydraulic drive with an electro-hydraulic transformer. Incoming electrical actuating signals are then converted to corresponding hydraulic currents, which produce corresponding actuating movements at the throttling organs or locking organs of the control valves 6 and 7.

Figure 2:
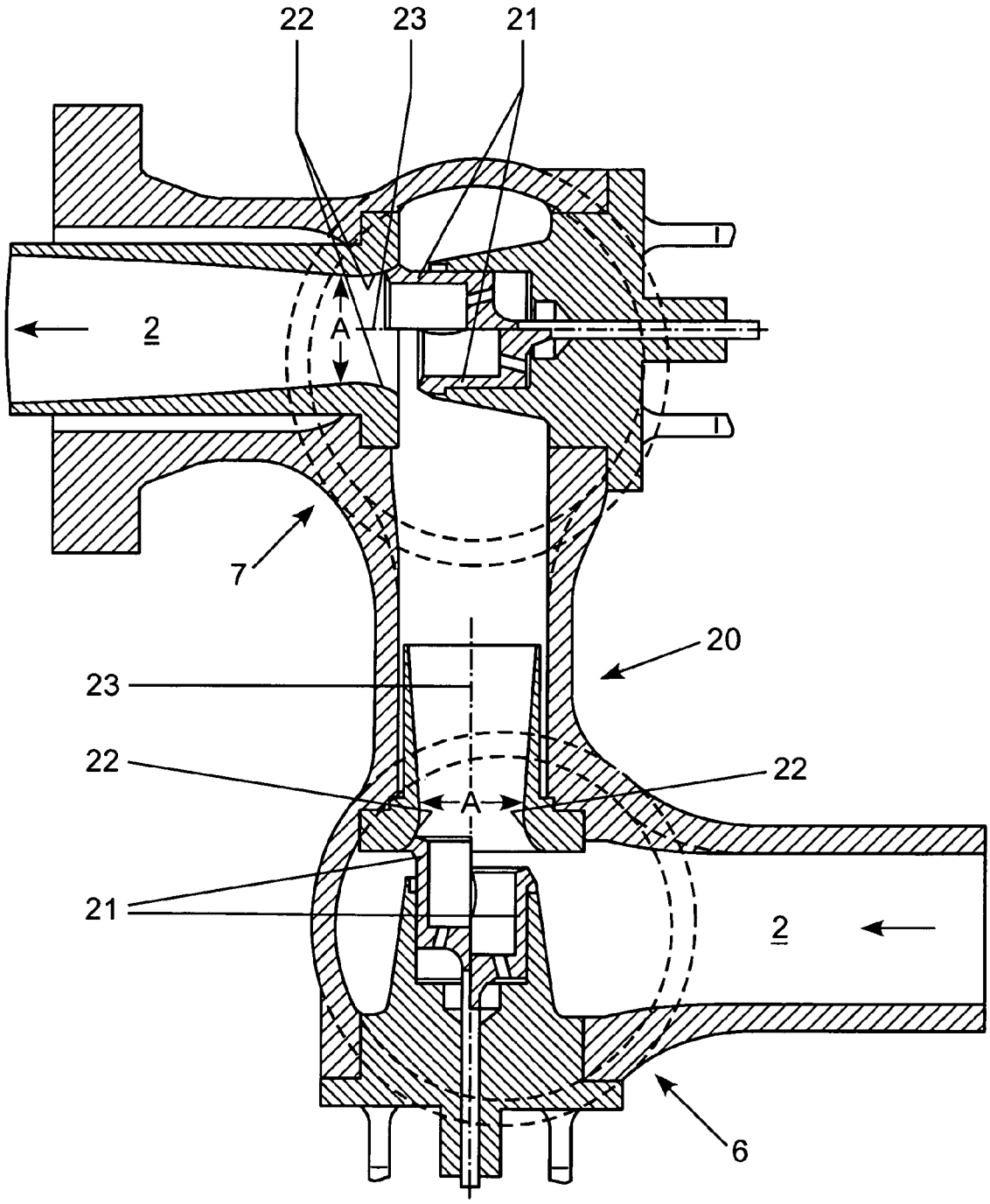
FIG. 2 shows a valve arrangement according to the invention, with two control valves of the balanced valve type, arranged in series in a angular type arrangement, FIG. 3, a valve arrangement according to the invention with two control valves of the type having a work clearance stroke, arranged in series in a angular type arrangement.

FIG. 2 shows an initial potential embodiment form of the valve arrangement according to the invention, in which the control valves are embodied as balanced valves. In keeping with FIG. 2, both control valves 6 and 7 can be combined in a common housing to a valve assembly 20, as a result of which the expenditure of installation effort when structurally incorporating the live steam feed line 2 is simplified. As is apparent from FIG. 2, both control valves 6 and 7 can, to good purpose be configured in a structurally equivalent manner, with identical or similar components. As a result of this, on the one hand, the multiplicity of the parts can be reduced, and, on the other hand, as a result of higher numbers of units, the price of the individual part can be reduced. In the case of the two control valves 6 and 7, the valve seats or diffusers 22 can be configured so as to be identical or different, as a result of which the two valves' flow cross-sectional area A are either identical or different.

Both control valves 6 and 7 are configured here as single-seat without pilot stroke in angular type configuration in the structural manner of balanced valves whose admission is oblique to the valve lift, whereas the direction of discharge runs against the direction of valve lift. To be able to realize this admission and discharge with 90° deviation in both control valves 6 and 7, in the case of the valve assembly 20, depicted here, both control valves 6 and 7 are arranged turned 90° toward each other. Accordingly, each control valve 6 contains a valve body 21, which interacts with a valve seat 22 in its closed position. In FIG. 2, for each valve body 21, one valve body half is depicted in the closed position of the valve body 21 and the other valve body half is depicted in the maximally opened position relative to a symmetry plane 23 that stands perpendicular on the plane of the drawing.

Figure 3:
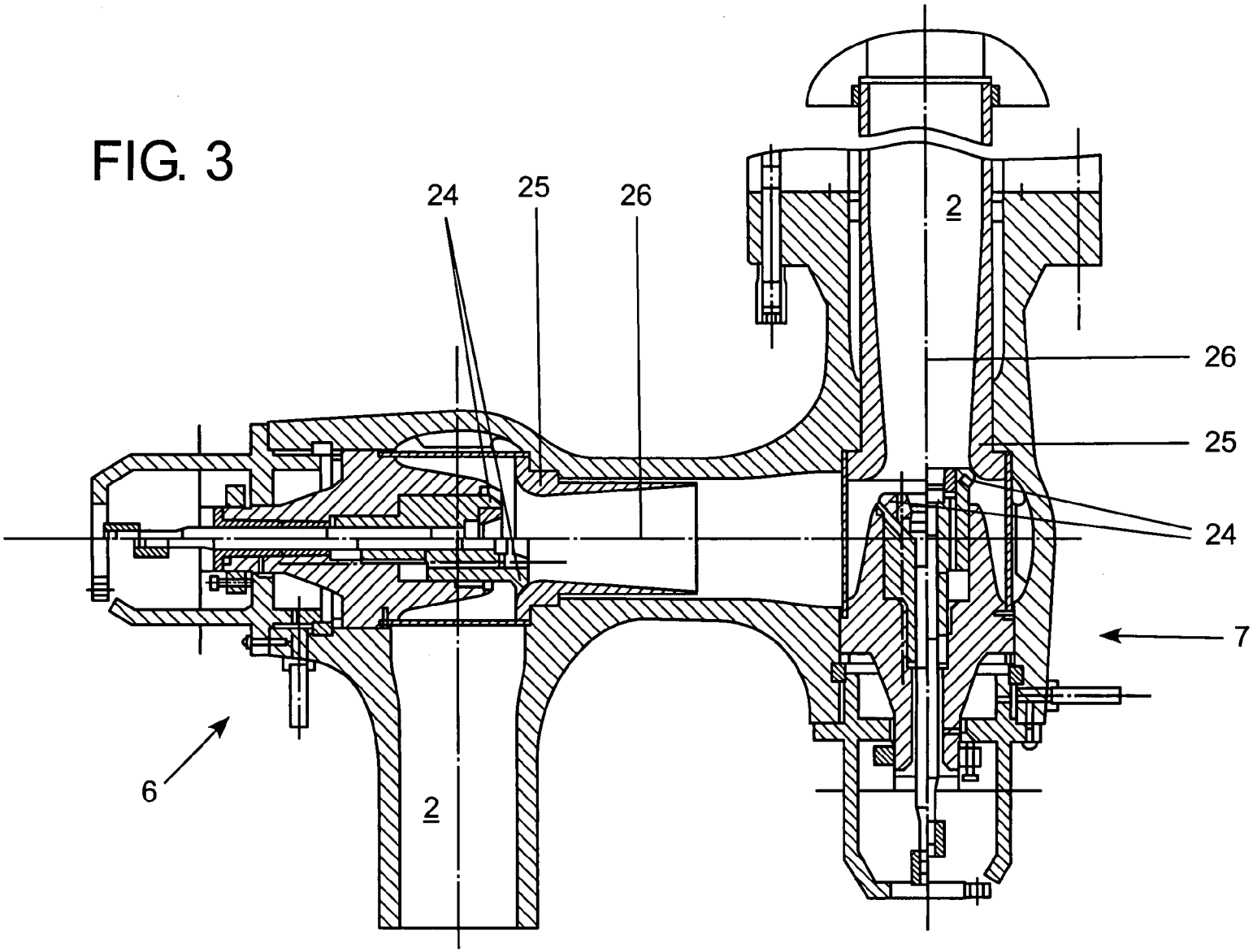

FIG. 3 shows another embodiment of the valve arrangement according to the invention. Here it is arranged in a angular type configuration by means of balanced single-seat valves with a pilot stroke. Similar to FIG. 2, both control valves 6 and 7 are turned 90° toward each other. Again, each control valve 6 contains a valve body 24, which, in the closed position, interacts with a valve seat 25. One valve body half is depicted in the closed position of valve body 24, and the other valve body half is depicted in the maximally opened open position of the valve body 24 for each valve body 24 on symmetry plane 26, which stands on the plane of the drawing.

The valve arrangement according to the invention is operated in the following manner:

The live steam pressure $P_{D1}$, which is set by the steam generator, is applied to the input side of the first control valve 6. This pressure can be either a firmly predetermined pressure, or a pressure variably predetermined by means of corresponding measures in the boiler. Steam turbine 3 is given a working pressure $P_{D2}$, which varies with the operational status of steam turbine 3. Now, with the aid of the valve arrangement 5, the live steam pressure $P_{D1}$, which is applied to the input side, is throttled to the current working pressure $P_{D2}$. According to the invention, this occurs in two steps, such that the invention comprises two distinct procedures for the first step:

According to the first procedure, the first control valve 6 throttles the live steam pressure $P_{D1}$ to an interim pressure $P_z$, such that this throttling occurs in a controlled manner. To this end, for example, the control valve 6 is set to a valve lift point. The resultant interim pressure is then variable, depending upon the live steam pressure $P_{D1}$. This interim pressure $P_z$ is, to good purpose, always somewhat higher than the maximum working pressure required by steam turbine 3, $P_{D2}$.

According to the second procedure, the variable live steam pressure $P_{D2}$ is controlled by means of the control valve 6 to a load-dependent interim pressure, $P_z$. The activation of the first control valve 6 is realized, for example, by means of a control circuit, whose reference input is formed, to good purpose, by the load-dependent interim pressure, $P_z$. To this end, control deviations are determined by means of a comparison of an ideal and actual values of the interim pressure $P_z$, and compensation is achieved by means of suitable control commands.

Now, in both procedures, the second control valve 7 throttles from the interim pressure $P_z$ to working pressure $P_{D2}$, such that this throttling occurs only in a controlled manner. One control circuit for the activation of the second control valve 7 contains as reference inputs, for example, the output of the steam turbine or the number of revolutions of the machine's rotor. The working pressure $P_{D2}$ is set in accordance with these reference inputs. That means that control deviations, which are set by means of a comparison of the ideal with the actual values of working pressure $P_{D2}$ or of the reference inputs by which the working pressure is adjusted are compensated for by suitable control commands.

Thus, the valve arrangement 5 in the case of the invention makes do with two simply constructed control circuits. As a result of this structure, the effort for closed-loop control and/or open-loop control of valve arrangement 5 is reduced. Furthermore, an enhanced degree of operational safety and reliability, which is due to a reduction of stress on the valves, results. Beyond that, the two-step throttling has the consequence that the maximum pressure differences, which are applied individually to the control valves 6 and 7, are definitely smaller than the pressure difference between live steam pressure $P_{D1}$ and working pressure $P_{D2}$, which causes the reduced stress upon the control valves 6 and 7. In particular, vibrations, oscillatory excitations, and the development of noise can be reduced or avoided altogether.

What is claimed is:

1. A steam turbine with a valve arrangement for controlling the input of live steam into the steam turbine, wherein two control valves are arranged in series in the direction of flow of the live steam, and each control valve comprises a single seat balanced valve, with a work clearance stroke or without a pilot stroke.

2. A steam turbine according to claim 1, wherein the steam turbine is configured with a control stage.

3. A steam turbine according to claim 1, wherein the flow cross-sectional areas of the two control valves are identical.

4. A steam turbine according to claim 1, wherein the flow cross-sectional areas of the two control valves are distinct.

5. A steam turbine according to claim 1, wherein the steam turbine is configured without a control stage.

6. A steam turbine according to claim 1, wherein the live steam prior to the valve arrangement is at a fixed pressure at all operational loads of the steam turbine.

7. A steam turbine according to claim 1, wherein the live steam prior to the valve arrangement has a variable pressure.

8. A steam turbine with a valve arrangement for controlling the input of live steam into the steam turbine, wherein two control valves are arranged in series in the direction of flow of the live steam, and each control valve comprises a single seat balanced valve, with a work clearance stroke or without a pilot stroke, wherein the two control valves each exhibit an actuating drive, which are connected with a control apparatus for open or closed-loop control of the actuating drives.

* * * * *